US012448096B2

(12) United States Patent
Goldsmith

(10) Patent No.: US 12,448,096 B2
(45) Date of Patent: Oct. 21, 2025

(54) WEIGHT POCKET LINER FOR BUOYANCY CONTROL DEVICE (BCD)

(71) Applicant: Lary Z Enterprises, Inc., Rocklin, CA (US)

(72) Inventor: Lawrence Irving Goldsmith, Rocklin, CA (US)

(73) Assignee: Lary Z Enterprises, Inc., Rocklin, CA (US)

( * ) Notice: Subject to any disclaimer, the term of this patent is extended or adjusted under 35 U.S.C. 154(b) by 154 days.

(21) Appl. No.: 18/105,148

(22) Filed: Feb. 2, 2023

(65) Prior Publication Data

US 2024/0262473 A1 Aug. 8, 2024

(51) Int. Cl.
*B63C 11/00* (2006.01)
*B63C 11/30* (2006.01)

(52) U.S. Cl.
CPC ..... *B63C 11/30* (2013.01); *B63C 2011/303* (2013.01)

(58) Field of Classification Search
CPC ..... B63C 11/30; B63C 2011/303
See application file for complete search history.

(56) References Cited

U.S. PATENT DOCUMENTS 254,152 A * 2/1882 O'Donnell et al. ..... B63C 7/30 441/32
617,675 A * 1/1899 Crawford ..... B63C 11/30 224/663
1,296,664 A * 3/1919 Holmes ..... B63C 9/20 441/15
1,741,057 A * 12/1929 Howe ..... A63B 55/50 206/315.8
1,866,438 A * 7/1932 Williamson ..... E21B 41/06 285/123.3
2,202,415 A * 5/1940 Christopher ..... B63C 9/155 441/92
2,313,151 A * 3/1943 Johnson ..... B63C 9/1255 156/289
2,409,367 A * 10/1946 Leguillon ..... B63C 9/1055 2/82
2,605,945 A * 8/1952 Dechar ..... A45F 5/10 220/759
2,869,548 A * 1/1959 Mason ..... A61F 5/448 604/340
2,906,263 A * 9/1959 Wolshin ..... B63C 11/30 128/205.18

(Continued)

*Primary Examiner* — Edwin J Toledo-Duran
(74) *Attorney, Agent, or Firm* — Sheppard Mullin Richter & Hampton LLP

(57) ABSTRACT

A device to facilitate weight operation in a Buoyancy Control Device (BCD) is described. The device may include a tubular body made from waterproof fabrics. The tubular body may have an exterior, a top opening, and a bottom opening. The device may include a semi-rigid tab and a pair of fastening assemblies attached to the exterior of the tubular body. The top opening may have boning that supports the top opening in an open state. The top end of the semi-rigid tab is fixed to the exterior and is close to the top opening of the tubular body, the bottom end of the semi-rigid tab is in contact with the exterior as a result of a rigidity of the semi-rigid tab. The pair of fastening assemblies are positioned on opposite sides of the semi-rigid tab.

20 Claims, 9 Drawing Sheets

(56) References Cited

U.S. PATENT DOCUMENTS 3,080,844 A * 3/1963 Lehmann ..... B63C 7/10 114/54
3,105,359 A * 10/1963 Ellis ..... B63C 11/08 441/106
3,256,538 A * 6/1966 Waller ..... B63B 22/22 367/106
3,324,489 A * 6/1967 Garcia ..... B63C 9/20 441/15
3,434,295 A * 3/1969 Manning ..... E21B 41/04 405/170
3,676,882 A * 7/1972 Lindqvist ..... B63C 9/26 441/85
3,777,498 A * 12/1973 Andrews ..... B63C 11/52 383/102
3,820,348 A * 6/1974 Fast ..... B63C 11/2245 441/96
3,838,758 A * 10/1974 Brown ..... B65D 29/00 383/38
3,864,773 A * 2/1975 Geary ..... B63C 9/155 441/94
3,967,459 A * 7/1976 Denis ..... B63C 11/2245 128/202.14
3,985,171 A * 10/1976 Summers ..... A63B 55/406 150/159
4,054,132 A * 10/1977 Deeds ..... B63C 11/30 128/202.14
4,137,585 A * 2/1979 Wright, III ..... B63C 11/2245 128/204.26
4,159,692 A * 7/1979 Dye, Jr. ..... B63C 7/06 114/333
4,239,211 A * 12/1980 Wilkerson ..... B63C 11/30 273/DIG. 30
4,249,586 A * 2/1981 Setani ..... A63B 55/00 206/315.4
4,343,158 A * 8/1982 Campbell ..... F25D 3/08 383/110
4,440,525 A * 4/1984 Perla ..... B63C 11/30 224/664
4,458,933 A * 7/1984 Thomas ..... B65G 7/12 D3/316
4,498,879 A * 2/1985 Burr ..... B63C 9/21 441/89
4,510,878 A * 4/1985 Breedlove ..... B63C 7/10 114/54
4,560,356 A * 12/1985 Burr ..... B63C 9/08 441/88
4,593,841 A * 6/1986 Lange ..... A45C 9/00 280/30
4,608,940 A * 9/1986 Bulin ..... B63C 11/30 114/331
4,700,654 A * 10/1987 Borges ..... B63C 11/46 440/70
4,732,305 A * 3/1988 Courtney ..... B63C 11/30 224/681
4,808,033 A * 2/1989 Belmonte ..... B63C 11/30 2/338
4,881,638 A * 11/1989 Cho ..... A63B 55/40 206/315.6
4,966,259 A * 10/1990 Bergman ..... A45C 13/262 190/117
5,011,055 A * 4/1991 Neugent ..... B62J 11/02 280/288.4
5,085,163 A * 2/1992 VanTassel ..... B63C 11/30 114/315
5,102,360 A * 4/1992 Eycleshimer ..... B63C 9/02 441/80
5,199,820 A * 4/1993 Nicklo ..... B63C 11/30 405/185
5,205,672 A * 4/1993 Stinton ..... B63C 11/30 405/186
5,209,328 A * 5/1993 Kotkins, Jr. ..... A45C 3/004 190/111
5,222,598 A * 6/1993 Yamazoe ..... A63B 55/00 224/617
5,255,673 A * 10/1993 Cardwell ..... B63C 11/325 405/185
5,269,449 A * 12/1993 Sattler ..... A45F 3/14 224/264
5,299,720 A * 4/1994 Koch, III ..... B62J 9/22 224/406
5,348,205 A * 9/1994 Steurer ..... A45F 3/14 224/259
5,373,801 A * 12/1994 Spickelmire ..... B63C 7/10 114/299
5,381,922 A * 1/1995 Gladman ..... A45F 5/02 D6/567
5,400,736 A * 3/1995 Gold ..... B63C 11/26 367/141
5,419,473 A * 5/1995 Lamar ..... A63B 55/00 206/315.6
5,429,288 A * 7/1995 Sattler ..... A45F 3/02 224/264
5,431,265 A * 7/1995 Yoo ..... A45C 3/00 190/111
5,507,332 A * 4/1996 McKinnon ..... A63B 55/406 150/159
5,567,084 A * 10/1996 Oliver ..... B63C 11/2245 256/32
5,593,077 A * 1/1997 Izzo ..... A63B 55/00 224/580
5,646,364 A * 7/1997 McClung ..... F42B 3/087 224/183
5,662,433 A * 9/1997 Seligman ..... A41D 13/0125 441/106
5,855,454 A * 1/1999 Courtney ..... B63C 9/155 441/108
5,913,640 A * 6/1999 Bortner ..... B63C 11/30 405/185
5,921,387 A * 7/1999 Arzoomanian ..... A63B 55/00 150/159
5,944,450 A * 8/1999 Anderson ..... B63C 11/30 441/106
5,950,889 A * 9/1999 Feldman, Jr. ..... A63B 55/00 206/315.3
5,956,291 A * 9/1999 Nehemiah ..... H04B 11/00 367/134
6,108,816 A * 8/2000 Bradley ..... A62B 99/00 2/102
6,145,660 A * 11/2000 Chou ..... A63B 55/40 206/315.6
6,146,053 A * 11/2000 Nelson ..... B63C 11/30 224/664
6,223,870 B1 * 5/2001 Godshaw ..... A45C 13/02 190/111
6,257,942 B1 * 7/2001 Groover ..... B63C 9/26 441/84
6,378,581 B1 * 4/2002 Sheridan ..... A63B 55/406 150/159
6,478,510 B1 * 11/2002 Young ..... B63C 11/08 441/106
6,513,816 B1 * 2/2003 Kijima ..... A63B 55/60 280/DIG. 6
6,527,479 B1 * 3/2003 Courtney ..... B63C 11/30 405/185
6,558,082 B1 * 5/2003 Courtney ..... B63C 9/1255 441/89
6,709,304 B1 * 3/2004 Young ..... B63C 7/26 441/6
6,712,557 B1 * 3/2004 Carmichael ..... B63C 11/08 224/934
6,749,370 B1 * 6/2004 Urabe ..... B63C 11/30 441/106
6,758,635 B1 * 7/2004 Feng ..... B63C 11/30 441/106
6,881,011 B1 * 4/2005 Carmichael ..... B63C 11/30 405/186
9,078,417 B1 * 7/2015 Lees ..... A45F 5/021
9,944,368 B1 * 4/2018 Faletra ..... B63C 9/23

(56) References Cited

U.S. PATENT DOCUMENTS 11,059,551 B1 * 7/2021 Perkins ..... B63C 11/26
D1,019,006 S * 3/2024 Cosseddu ..... D30/109
2001/0016149 A1 * 8/2001 Garofalo ..... B63C 11/30 441/106
2002/0013107 A1 * 1/2002 Angelini ..... B63C 11/30 441/88
2002/0066763 A1 * 6/2002 Hsueh ..... A63B 55/40 206/315.6
2002/0067955 A1 * 6/2002 Carmichael ..... B63C 11/30 405/186
2002/0088834 A1 * 7/2002 Wolfgram ..... B62K 3/002 224/652
2003/0029751 A1 * 2/2003 Boardman ..... A45C 13/36 150/159
2003/0211790 A1 * 11/2003 Cressi ..... B63C 11/08 441/88
2004/0023574 A1 * 2/2004 Calkin ..... A62B 1/16 441/88
2004/0031836 A1 * 2/2004 Garcia ..... F42B 39/02 224/679
2004/0118718 A1 * 6/2004 Karlsson ..... A63B 55/57 206/315.5
2004/0129311 A1 * 7/2004 Courtney ..... F16K 15/20 137/223
2004/0134811 A1 * 7/2004 Lai ..... A63B 55/00 206/315.3
2004/0157514 A1 * 8/2004 Courtney ..... B63C 9/155 441/88
2004/0258481 A1 * 12/2004 Courtney ..... B63C 11/2245 405/187
2005/0074295 A1 * 4/2005 Kawashima ..... B63C 11/30 405/185
2005/0098597 A1 * 5/2005 Cottrell ..... B63C 11/30 224/629
2005/0235393 A1 * 10/2005 Rockwell ..... A41D 13/0125 2/108
2005/0236080 A1 * 10/2005 Potter ..... A63B 55/406 150/159
2006/0018718 A1 * 1/2006 Angelini ..... B63C 11/02 405/185
2006/0076186 A1 * 4/2006 Lindqvist ..... B63C 9/26 182/70
2006/0081671 A1 * 4/2006 Grant ..... A63B 55/408 224/907
2006/0113346 A1 * 6/2006 Togo ..... A63B 55/408 206/315.3
2006/0151560 A1 * 7/2006 Chen ..... A45C 7/0068 190/103
2006/0163094 A1 * 7/2006 Chiang ..... A63B 55/30 206/315.7
2006/0175492 A1 * 8/2006 Cooper ..... B63C 11/22 248/229.17
2006/0243188 A1 * 11/2006 Pradetto ..... B63C 11/46 114/315
2006/0270290 A1 * 11/2006 Tellew ..... B63C 9/18 441/88
2007/0152004 A1 * 7/2007 Rooney ..... A45F 3/12 224/907
2008/0188148 A1 * 8/2008 Simon-Bouhet ..... B63C 9/04 14/71.1
2009/0032419 A1 * 2/2009 Kealy ..... A63B 47/00 206/315.9
2009/0148240 A1 * 6/2009 Carmichael ..... B63C 11/30 405/186
2009/0276982 A1 * 11/2009 Nossa ..... B65D 43/22 24/305
2010/0032328 A1 * 2/2010 Gillain ..... B65D 85/305 206/427
2010/0051657 A1 * 3/2010 Onessimo ..... A45F 3/04 224/642
2010/0136862 A1 * 6/2010 Vick ..... B63C 9/11 441/118
2010/0136863 A1 * 6/2010 Vick ..... B63C 9/115 441/118
2010/0136864 A1 * 6/2010 Vick ..... B63C 9/30 441/127
2010/0288801 A1 * 11/2010 Messner ..... A45F 5/021 224/101
2011/0191988 A1 * 8/2011 Wein ..... H01F 7/0263 24/303
2011/0240692 A1 * 10/2011 Park ..... A45F 3/04 224/155
2011/0305520 A1 * 12/2011 West ..... B63C 7/26 362/234
2012/0171911 A1 * 7/2012 Pisor ..... B63C 11/26 441/12
2012/0214371 A1 * 8/2012 Pisor ..... B63C 9/20 441/80
2012/0252290 A1 * 10/2012 Lee ..... B63C 9/065 441/87
2013/0067691 A1 * 3/2013 Godoy ..... A44B 11/2592 24/3.1
2013/0149038 A1 * 6/2013 Toth ..... B63C 11/30 405/186
2013/0283510 A1 * 10/2013 Berchten ..... A62B 33/00 2/455
2013/0291781 A1 * 11/2013 Myers ..... B63C 11/46 114/315
2014/0014096 A1 * 1/2014 Godoy ..... B63C 11/207 128/201.11
2014/0131372 A1 * 5/2014 Hiner ..... B65D 81/3876 220/739
2014/0177982 A1 * 6/2014 Al Haj Eid ..... D06F 95/00 383/117
2015/0084296 A1 * 3/2015 Murphy ..... B62B 1/045 280/40
2015/0129628 A1 * 5/2015 Messner ..... B63C 11/22 224/600
2015/0232159 A1 * 8/2015 Masutani ..... B63C 11/30 405/186
2015/0298496 A1 * 10/2015 Payne ..... B44D 3/14 220/696
2016/0001859 A1 * 1/2016 Greenfield ..... B63B 22/166 441/6
2016/0022067 A1 * 1/2016 Day ..... B65D 81/3879 220/737
2016/0102427 A1 * 4/2016 Cohen ..... A45F 3/04 224/645
2016/0198808 A1 * 7/2016 Noceti ..... A44B 11/26 24/606
2016/0221654 A1 * 8/2016 Kang ..... B63C 11/18
2016/0324079 A1 * 11/2016 Belschner ..... A47G 33/04
2017/0265599 A1 * 9/2017 Angelini ..... A44B 11/2569
2018/0273150 A1 * 9/2018 Palanisamy ..... B63C 9/081
2020/0046097 A1 * 2/2020 Porter ..... A45F 3/04
2020/0128943 A1 * 4/2020 D'Alessandro ..... A45F 3/047
2021/0137230 A1 * 5/2021 Lund ..... A45C 13/001
2021/0380208 A1 * 12/2021 Smith ..... B63C 7/02
2021/0386168 A1 * 12/2021 Younger ..... A45C 7/0086
2023/0083750 A1 * 3/2023 Czernik ..... A62B 35/0006 405/186
2023/0098142 A1 * 3/2023 Bassoo ..... A63B 21/4007 482/105
2024/0262474 A1 * 8/2024 Angelini ..... B63C 11/30

* cited by examiner

WEIGHT POCKET LINER FOR BUOYANCY CONTROL DEVICE (BCD)

TECHNICAL FIELD

This disclosure relates generally to a weight system for a Buoyancy Control Device (BCD), and more specifically to a removable weight pocket liner for weight pockets of BCD (the weight pockets may be integrated into the BCD or detachable from the BCD) to facilitate weight insertion and extraction.

BACKGROUND

A Buoyancy Control Device (BCD) is an essential piece of diving equipment that helps divers control their buoyancy underwater. When divers are underwater, the buoyancy of their diving suits, tanks, and other equipment can cause them to float or sink. FIG. 1A illustrates a popular BCD device. To help counteract this buoyancy, a diver uses weights to add additional weight to the BCD, which helps him/her to descend and maintain the desired depth while diving. To use weights with the BCD, the diver typically adds enough weight to weight pockets (e.g., the two weight pockets 10 on each side of the BCD in FIG. 1A, which may be integrated into the BCD or detachable from the BCD) to enable him/her to descend to the desired depth. Once at the desired depth, the diver can use the BCD's inflator mechanism to adjust their buoyancy and maintain their depth.

FIG. 1B illustrates close-up views of the weight pocket, which has a flap 12 at the opening designed to secure the weight pouch. To insert weights (e.g., in the form of weight pouches) into a weight pocket 10 of the BCD for diving, the diver needs to hold the BCD steady and open the weight pocket flap, insert the weight pouch of a desired amount of weight into the weight pocket, and close the weight pocket flap and secure it in place. Some BCDs have a Velcro closure, while others may have a buckle or a zipper closure. To extract the weights from the weight pocket, the diver needs to reverse the above steps.

However, it is often a challenge to insert weight pouches into or remove them from the weight pockets of the BCD. The weight pouch is usually made of a heavy canvas-type material while the pockets are essentially rubber. The combination of these two materials results in a very high level of friction when the two items met one another. Additionally, as shown in FIG. 1B, the flap 12 at the opening of the weight pocket tends to flop closed, which creates another point of difficulty when trying to insert the weighted pouches into or remove them from these weight pockets. While wearing the BCD, it takes another person to assist in getting the weighted pouches fully inserted into the BCD pocket. An alternative method is to insert the weight pouches into the BCD before putting it on. This too requires the assistance of another person or the ability to place the weighted BCD and tank on a shelf or platform in order to climb into it. This is true even when the weight pouch is dry. To make matters worse, the level of difficulty significantly increases when removing the pouches in an emergency (e.g., under deep water with limited visibility) when weight needs to be quickly removed or dumped.

This disclosure describes a weight pocket liner designed to address the above-described challenges.

SUMMARY

In some embodiments, the techniques described herein relate to a weight pocket liner for a buoyancy control device (BCD) to facilitate insertion and removal of weights, including: a tubular body made from waterproof fabrics, wherein the tubular body includes an exterior, a top opening, and a bottom opening; a semi-rigid tab attached to the exterior of the tubular body; a pair of fastening assemblies attached to the exterior of the tubular body; wherein: the top opening includes boning that supports the top opening in an open state; the semi-rigid tab includes a top end and a bottom end, wherein: the top end is fixed to the exterior and is close to the top opening of the tubular body, the bottom end is in contact with the exterior as a result of a rigidity of the semi-rigid tab, and the bottom end is lifted away from the exterior when a lifting force is applied and back in contact with the exterior when the lifting force disappears; the pair of fastening assemblies are positioned on opposite sides of the semi-rigid tab; and the semi-rigid tab and the pair of fastening assemblies are parallel to each other and extended between the top opening and the bottom opening of the tubular body.

In some embodiments, the bottom end of the semi-rigid tab includes a rounded or tapered tip to facilitate insertion.

In some embodiments, at least the rounded or tapered tip of the semi-rigid tab uses a color that is different from the color of the exterior of the tubular body.

In some embodiments, the semi-rigid tab includes an arched middle section between the top end and the bottom end, and the arched middle section is raised away from the exterior of the tubular body.

In some embodiments, the bottom end of the semi-rigid tab includes a tip with a base side connecting to the body of the semi-rigid tab, wherein the base side of the tip is wider than the width of the body of the semi-rigid tab so that the base side of the tip includes two edges extending from the body of the semi-rigid tab.

In some embodiments, the pair of fastening assemblies includes a first Velcro assembly positioned to a left side of the semi-rigid tab and a second Velcro assembly positioned to the right side of the semi-rigid tab.

In some embodiments, each of the first Velcro assembly and the second Velcro assembly includes: a hook side fixed onto the exterior of the tubular body; and a first loop side with an upper end fixed onto the exterior of the tubular body at a first position close to the top opening.

In some embodiments, each of the first Velcro assembly and the second Velcro assembly further includes: a second loop side with a bottom end fixed onto the exterior of the tubular body at a second position close to the bottom opening.

In some embodiments, the hook side is wider than the first loop side.

In some embodiments, a first position at which the first loop side is fixed on the exterior is higher than the top of the hook side such that there is a gap between the first position and the top of the hook side.

In some embodiments, the weight pocket liner may further include: a pair of boning supports on opposite sides of the tubular body, wherein each of the pair of boning supports extends from the top opening to the bottom opening, and are respectively underneath the pair of fastening assemblies.

In some embodiments, the waterproof fabrics include Polyester canvas with Polyvinyl Chloride (PVC) Backing.

In some embodiments, the waterproof fabrics are at least 0.55 mm in thickness and includes a 600×600 denier.

In some embodiments, the semi-rigid tab includes boning material providing rigidity that is stronger than the rigidity of the boning supporting the top opening of the tubular body.

In some embodiments, the top end of the semi-rigid tab is aligned with the top opening of the tubular body.

In some embodiments, the top end of the semi-rigid tab is at least one inch by one inch in size and sewn into the tubular body.

In some embodiments, the top opening of the tubular body has a circumference between 12 inches and 14 inches.

In some embodiments, the tubular body of the weight pocket liner has a height between 8 inches and 10 inches.

In some embodiments, the boning supporting the top opening has a thickness of a half inch.

In some embodiments, the top end is fixed to the exterior by one of the following ways: sewing in, Velcro, button, zipper, or Staple gun.

BRIEF DESCRIPTION OF THE DRAWINGS

FIG. 5*b* illustrates how the semi-rigid tab of the weight pocket liner is engaged with the weight pocket.

DETAILED DESCRIPTION

Figure 2:
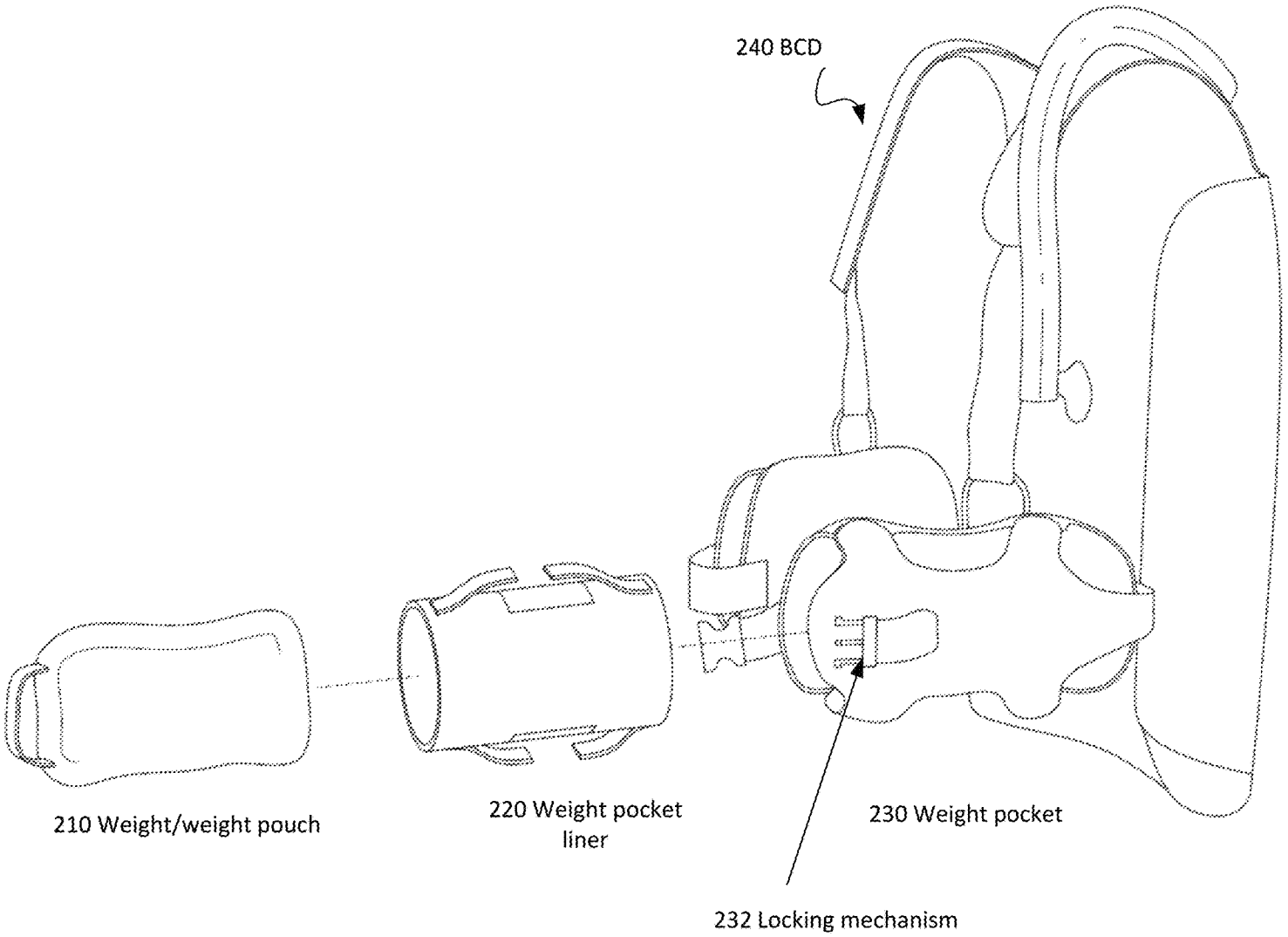
FIG. 2 illustrates an example weight pocket liner to facilitate the insertion and removal of a weight/weight pouch in and out of a weight pocket on a BCD.

Embodiments of the described invention provide a weight pocket liner that is compatible with weight pockets of BCDs from various popular brands. The weight pocket liner is easily inserted into the weight pockets of a BCD and keeps the weight pocket mouth open to facilitate finding (given limited visibility when wearing a wet suit and hood) and inserting the weight pouches into or removing them from the weight pockets. In addition, the waterproof fabrics on the interior of the weight pocket liner also effectively reduce the friction when operating the weight pouches (especially underwater). FIG. 2 illustrates an example weight pocket liner 220 to facilitate the insertion and removal of weight or weight pouch 210 in and out of a weight pocket 230 on a BCD. The weight pocket 230 may have a locking mechanism (e.g., locking strap buckles as shown in FIG. 2) to secure the weight 210 once inserted. In addition to the locking mechanism, the weight pocket liner 220 may be secured in place inside the weight pocket 230 using a series of hooking, attachment, or fastening points, as illustrated in FIG. 3.

Figure 3:
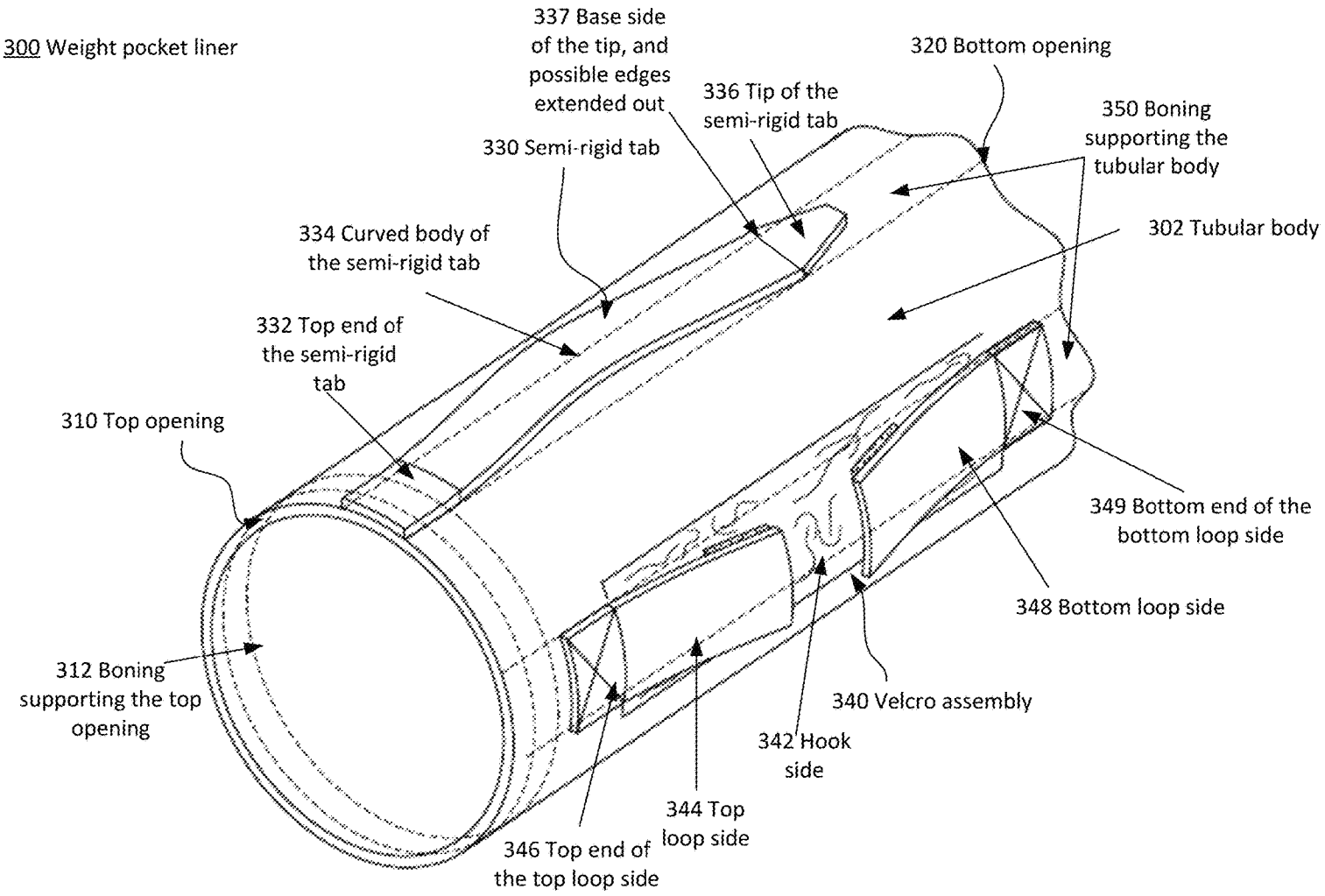
FIG. 3 illustrates a weight pocket liner in accordance in accordance with some embodiments.

FIG. 3 illustrates a weight pocket liner 300 in accordance in accordance with some embodiments. Referring to FIG. 3, the weight pocket liner 300 may have a tubular body 302 made from waterproof fabrics. The tubular body 302 has an exterior, an interior, a top opening 310, and a bottom opening 320.

In some embodiments, the tubular body 302 of the weight pocket liner 300 may be made from two pieces of fabric sewed together, with one piece of fabric forming the exterior and the other piece of fabric forming the interior. In some embodiments, the weight pocket liner 300 may be made from a plurality of pieces of fabric, with one large piece forming the tubular body, and other smaller pieces for covering boning on the tubular body 302 or at the top opening 310.

In some embodiments, the top opening 310 of the weight pocket liner 300 may have boning 312 to provide support and structure. For example, the boning 312 may be sandwiched between (e.g., sewed-in) the top edges of the weight pocket liner 300. The boning 312 may use thin and rigid strips of materials, such as plastic or steel, to create a defined shape. The boning material is stiff enough to hold the top opening 310 of the weight pocket liner 300 in an open shape, and is somewhat flexible when pressure applies. With the boning 312, the top opening 310 of the weight pocket liner 300 is kept open even after being inserted and secured in the weight pocket of a BCD.

Figure 1A:
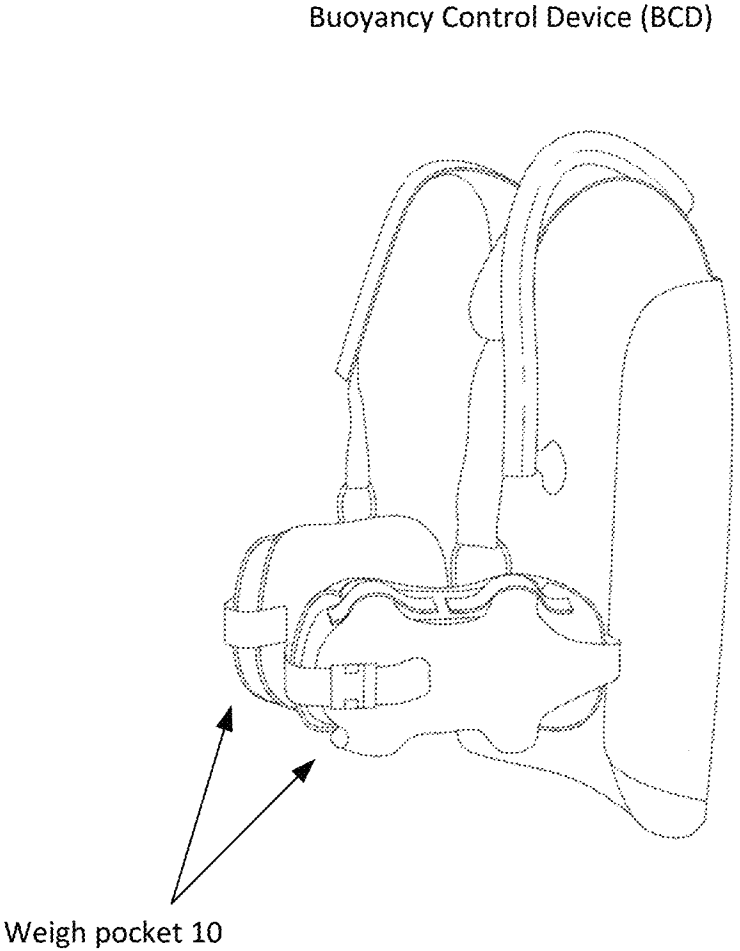
FIG. 1*a* illustrates a BCD device.
Figure 1B:
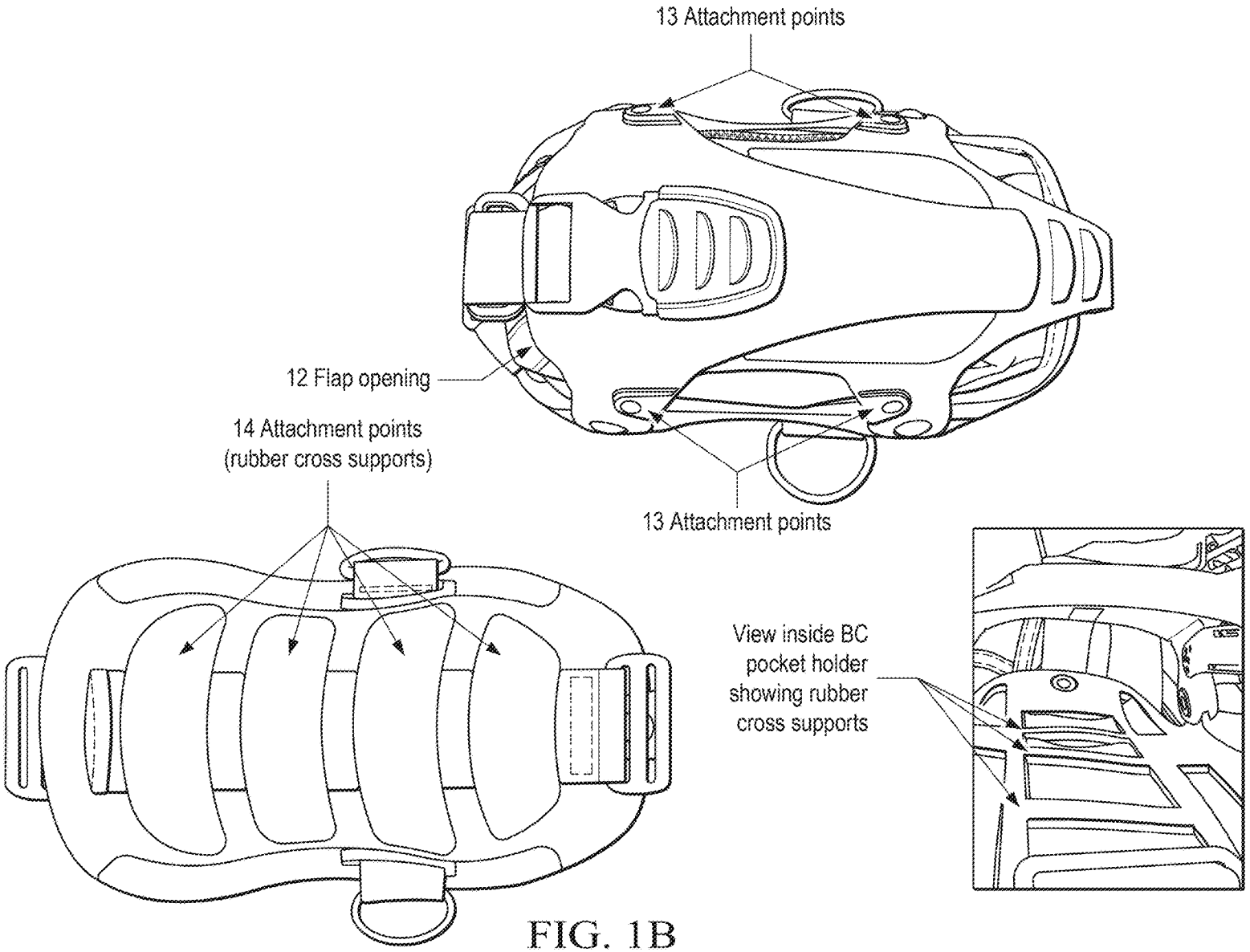
FIG. 1*b* illustrates close-up views of the weight pocket, which has a flap at the opening designed to secure the weight pouch.

In some embodiments, the weight pocket liner 300 may have a semi-rigid tab 330 and at least two fastening assemblies fixed to the exterior to help secure the weight pocket liner 300 within a weight pocket of a BCD. The semi-rigid tab 330 and the at least two fastening assemblies are designed to engage with the attaching points of the weight pocket (e.g., the rubber cross supports/straps on the back of the weight pocket, such as attachment points 14 in FIG. 1B, the handles on the rubber shell of the weight pocket, such as attachment points 13 in FIG. 1B).

Figure 4:
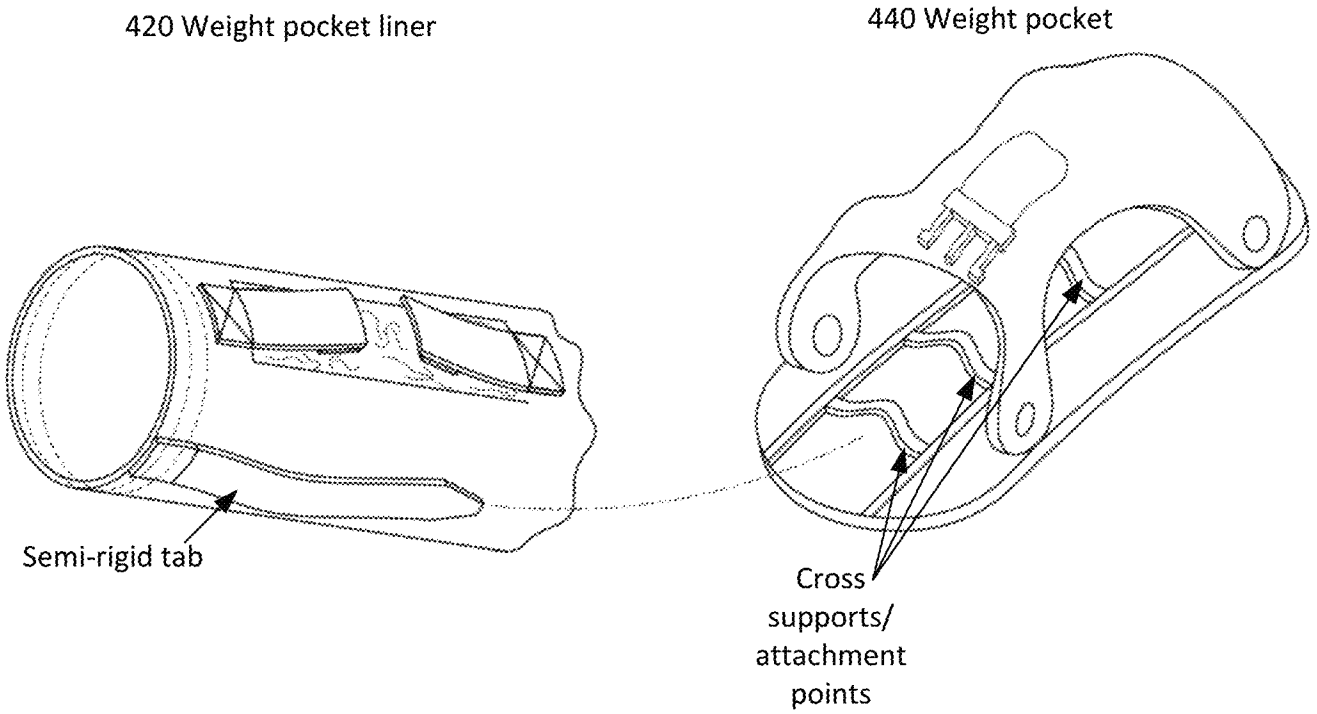
FIG. 4 illustrates how the semi-rigid tab of the weight pocket liner may be inserted into the cross supports (or another form of attachment points) of the weight pocket.

For example, the semi-rigid tab 330 (also called a locator tab) may be inserted into the straps (e.g., rubber cross support 14 in FIG. 1B) on the back of the weight pocket (to stabilize the liner) when placing the weight pocket liner 300 into the weight pocket. FIG. 4 illustrates how the semi-rigid tab of the weight pocket liner 420 may be inserted into the cross supports (or another form of attachment points) of the weight pocket 440. The rigidity of the semi-rigid tab keeps the tab engaged with the cross supports thereby securing the weight pocket liner 420 inside the weight pocket 440.

Referring back to FIG. 3, in some embodiments, the semi-rigid tab 330 may be a strip of semi-rigid material that extends from the top opening 310 of the weight pocket liner 300. Similar to the boning 312 at the top opening 310, the material for the semi-rigid tab 330 may have some degree of flexibility or ductility, but are not as pliable as fully flexible materials. Some example materials for the tab may include plastic, metal (e.g., a metal strip made from aluminum, steel, or brass), wood (strong and lightweight), fiberglass (a type of composite material that is made from fine strands of glass that are embedded in a resin matrix), rubber, or composite materials (e.g., polyvinyl chloride (PVC), Polycarbonate, Acrylic). In some preferred embodiments, plastic may be used because they are lightweight, corrosion-resistant, and relatively low-cost. The rigidity of the semi-rigid tab 330 may be stronger than the rigidity of the top opening 310 of the weight pocket liner 300.

The semi-rigid tab 330 may have a narrower width and a longer length, which includes a top end 332, a curved body 334, and a tip 336. The top end 332 of the semi-rigid tab 330 (e.g., a square or rectangle section on one end of the tab) may be fixed to the exterior of the tubular body 302, close to or part of the top opening 310 of the weight pocket liner 300, and aligned with the top opening 310 of the weight pocket liner 300. The top end 332 of the semi-rigid tab 330 may be fixed to the exterior in one of the following ways: sewed in, Velcro, button, zipper, or Staple gun. The top end may be at least one inch by one inch in size.

The body 334 of the semi-rigid tab 330 may be an arched section between the top end 334 and the tip 336, which is raised away from the exterior of the tubular body 302. The arch in the middle is designed to keep the lower portion of the tab 330, at its natural state, in contact with the exterior of the weight pocket liner 300 as a result of the rigidity of the semi-rigid tab 330. After being inserted in a weight pocket, this design allows the body 334 (middle section) of the tab to have some space for the attachment points (such as the rubber cross supports/straps 14 illustrated in FIG. 1B) of the weight pocket and at the same time keep the tip 336 of the semi-rigid tab 330 attached to the weight pocket.

The tip 336 of the semi-rigid tab 330 is the leading end when inserting the weight pocket liner 300 into the weight pocket of the BCD. The tip 336 may be lifted away from the exterior when a lifting force is applied and back in contact with the exterior when the lifting force disappears. In some embodiments, the tip 336 of the semi-rigid tab 330 may have a rounded or tapered shape to facilitate insertion. The rounded or tapered tip 336 of the semi-rigid tab 330 may use a color that is different from the color of the exterior of liner 300 to help a diver to see where the tab 330 is when inserted into the weight pocket.

In some embodiments, the tip 336 of the semi-rigid tab 330 has a base side 337 connecting to the body of the semi-rigid tab 330, and the base side 337 of the tip 336 may be wider than the width of the body 334 of the semi-rigid tab 330 so that the base side 337 of the tip 336 has two edges extending from the body 334 of the semi-rigid tab 330. The two edges extended from the body 334 may provide additional latches/hooks to prevent the tab 330 from slipping out of the weight pocket after being inserted, thereby further securing the tab inside the weight pocket.

In some embodiments, the pair of fastening assemblies may include a first Velcro assembly positioned on the left side of the semi-rigid tab 330 and a second Velcro assembly positioned on the right side of the semi-rigid tab 330. The distance between the first Velcro assembly and the semi-rigid tab 330 is equal to the distance between the second Velcro assembly and the semi-rigid tab 330. In some embodiments, the Velcro assemblies may be replaced with other fastening mechanisms, such as snap fasteners, zippers, buttons, laces, buckles, hooks, eye closures, or magnetic closures.

Except for the different positions, the two Velcro assemblies may be configured in the same way. For simplicity, only one of the Velcro assemblies 340 is described in the following description.

In some embodiments, each of the Velcro assemblies 340 may include one hook side 342 and at least one loop side. The hook side 342 may be wider than the loop sides. The hook side 342 may be sewn into the exterior of the weight pocket liner 300 in its entirety. A first loop side 344 has its top end 346 sewn into the exterior of the weight pocket liner 300 at a first position close to the top opening 310 of the weight pocket liner 300. The body and the bottom end of the first loop side are left free, which allows the first loop side 344 to be opened and closed by attaching and detaching from the hook side 342. The first position at which the top end 346 of the first loop side is sewn may be higher than the top of the hook side 342 such that there is a gap between the first position and the top of the hook side 342.

In some embodiments, the Velcro assembly 340 may have a second loop side 348 sharing the hook side 342 with the first loop side 344. The second loop side 348 may have a bottom end 349 sewn into the exterior of the weight pocket liner 300 at a second position close to the bottom opening 320 of the weight pocket liner 300. The body and the top end of the second loop side 348 are left free, which allows the second loop side 348 to be opened and closed by attaching and detaching from the hook side 342. The second position at which the bottom end 349 of the second loop side 348 is sewn may be lower than the bottom of the hook side 342 such that there is a gap between the second position and the bottom of the hook side 342.

In some embodiments, the tubular body 302 of the weight pocket liner 300 may have boning 350 (e.g., strips) underneath each of the semi-rigid tab 330 and the two Velcro assemblies 340. The boning 350 may extend from the top opening 310 to the bottom opening 320 of the weight pocket liner 300. The boning may be sewn into the tubular body to provide structural support.

In some embodiments, the weight pocket liner 300 may be made from waterproof fabrics, such as Polyester canvas with Polyvinyl Chloride (PVC) Backing. The fabrics are at least 0.55 mm in thickness and comprise a 600×600 denier. The seams on the tubular body are covered with Ottertex fabrics.

Figure 5A:
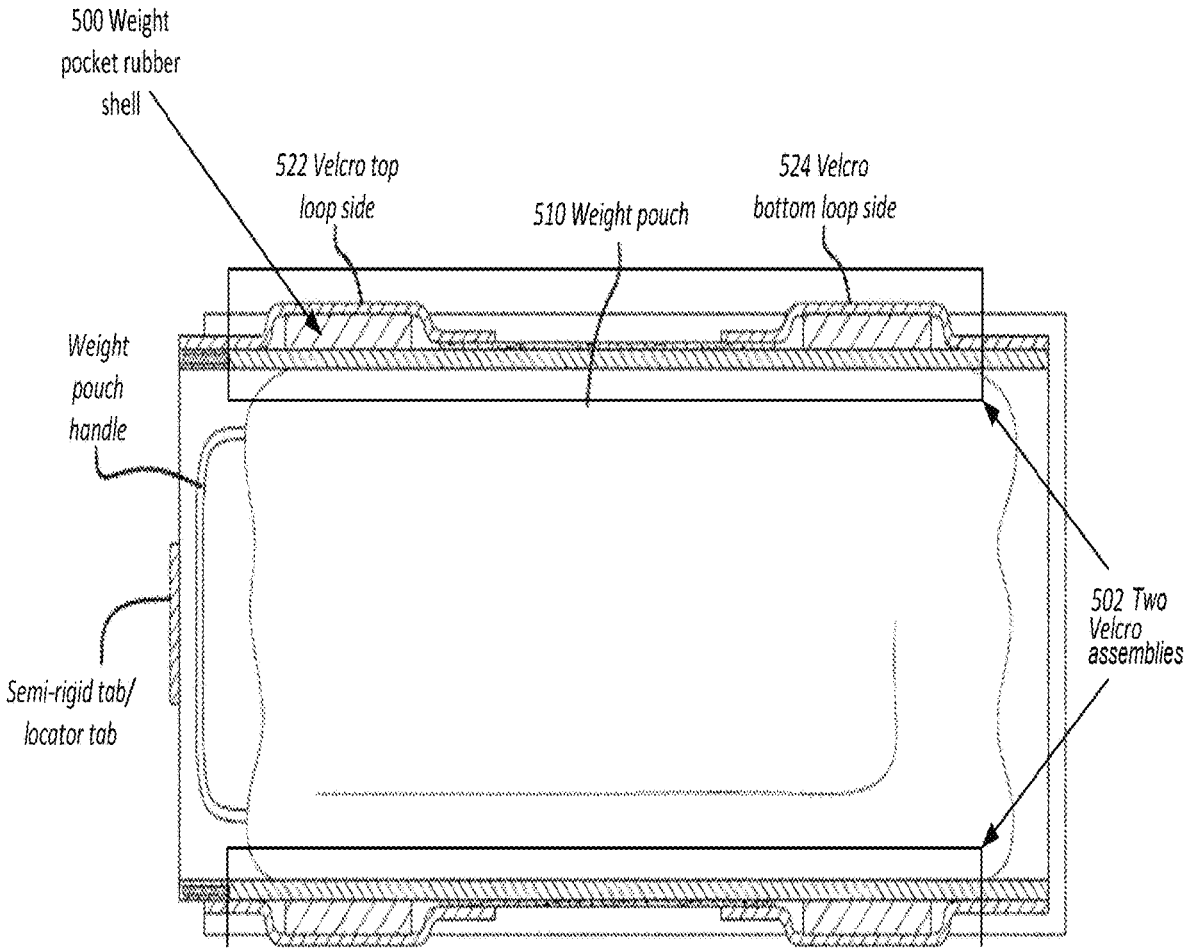
FIG. 5*a* and FIG. 5*b* illustrate section views of a weight pocket with a weight pocket liner and a weight pouch inserted, wherein the weight pocket liner sits in between the weight pouch and the weight pocket.
Figure 5B:
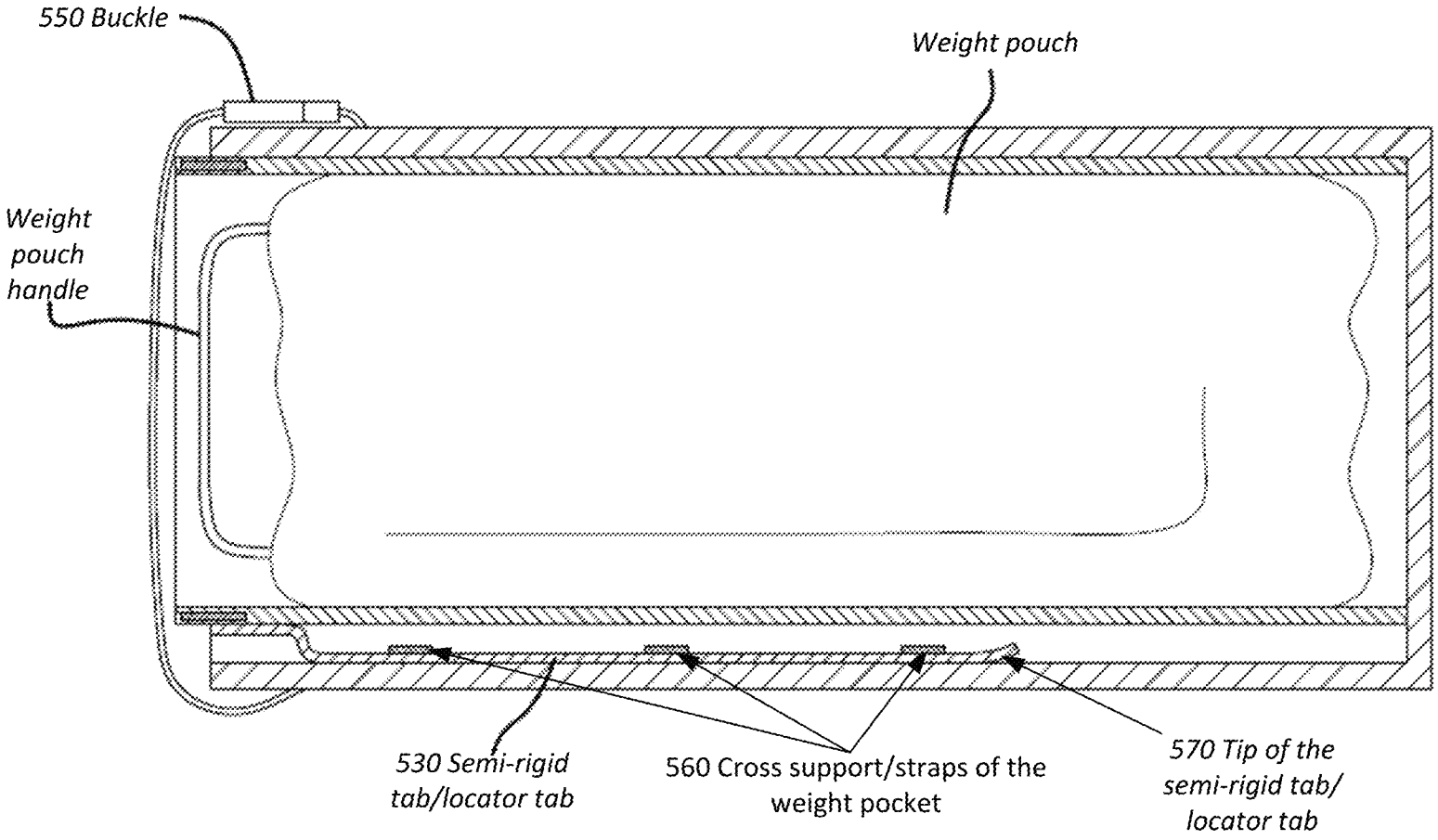

FIG. 5A and FIG. 5B illustrate section views of a weight pocket with a weight pocket liner and a weight pouch 510 inserted, wherein the weight pocket liner sits in between the weight pouch 510 and the weight pocket. In FIG. 5A, two Velcro assemblies 502 are illustrated. As shown, the loop sides (522 and 524) of each Velcro assembly 502 are fastened onto the weight pocket rubber shell 500. FIG. 5B illustrates how the semi-rigid tab 530 of the weight pocket liner is engaged with the weight pocket. As shown, the semi-rigid tab 530 is inserted into the cross supports/straps 560 of the weight pocket (e.g., the straps on the weight pocket rubber case). The tip 570 of the semi-rigid tab is naturally curved inwards because of the rigidity of the semi-rigid tab. After the weight pouch is in place, the weight pocket may have additional locking mechanisms to further secure the weight pouch and the weight pocket liner. For instance, the weight pocket may have a buckle 550 with an adjustable length. The buckle 550 may buckle over the top opening of the weight pocket.

Size

In some embodiments, the top opening of the weight pocket liner 300 may have a circumference between 12 inches and 14 inches. In a preferred embodiment, the weight pocket liner 300 may have a circumference of 12.5 inches.

The weight pocket liner 300 may have a height between 8 inches and 10 inches. In a preferred embodiment, the weight pocket liner 300 may have a height of 9.5 inches.

In some embodiments, the length of the semi-rigid tab may have a length between 7 inches and 8 inches, and a width between 1 inch and 2 inches. In a preferred embodiment, the semi-rigid tab may be 7.5 inches in length and 1.5 inches in width.

In some embodiments, each of the Velcro assembly has a hook side with a length between 4-6 inches and a width between 1-3 inches, a first loop side with a length between 4-5 inches and a width between 1-2 inches, and a second loop side with a length of 4-5 inches and a width between 1-2 inches. In a preferred embodiment, the hook side is 2 inches by 5 inches in size, the first loop side is 4.5 inches by 1 inch in size, and the second loop side is 5 inches by 1 inch in size.

In some embodiments, the boning supporting the top opening of the weight pocket liner 300 may have a length between 13-14 inches and a width between 0.5-1 inch. In a preferred embodiment, the boning supporting the top opening of the weight pocket liner 300 may be 13.5 inches by 0.5 inches in size.

In some embodiments, three separate and parallel semi-rigid strips may extend from the top opening to the end opening of the weight pocket liner 300 and be fixed on the body of the weight pocket liner 300. The three semi-rigid strips may be used as boning to support the body of the weight pocket liner 300. Each of the semi-rigid strips may be 9 inches by 0.5 inches in size. The three semi-rigid strips may be respectively placed under the first Velcro assembly, the semi-rigid tab (location tab), and the second Velcro assembly.

In the above descriptions, when the term "between" is used with a range, both the endpoints of the range are included. For example, a length between 3-4 inches means the length may be 3 inches, 4 inches, or any length in between.

Figure 6:
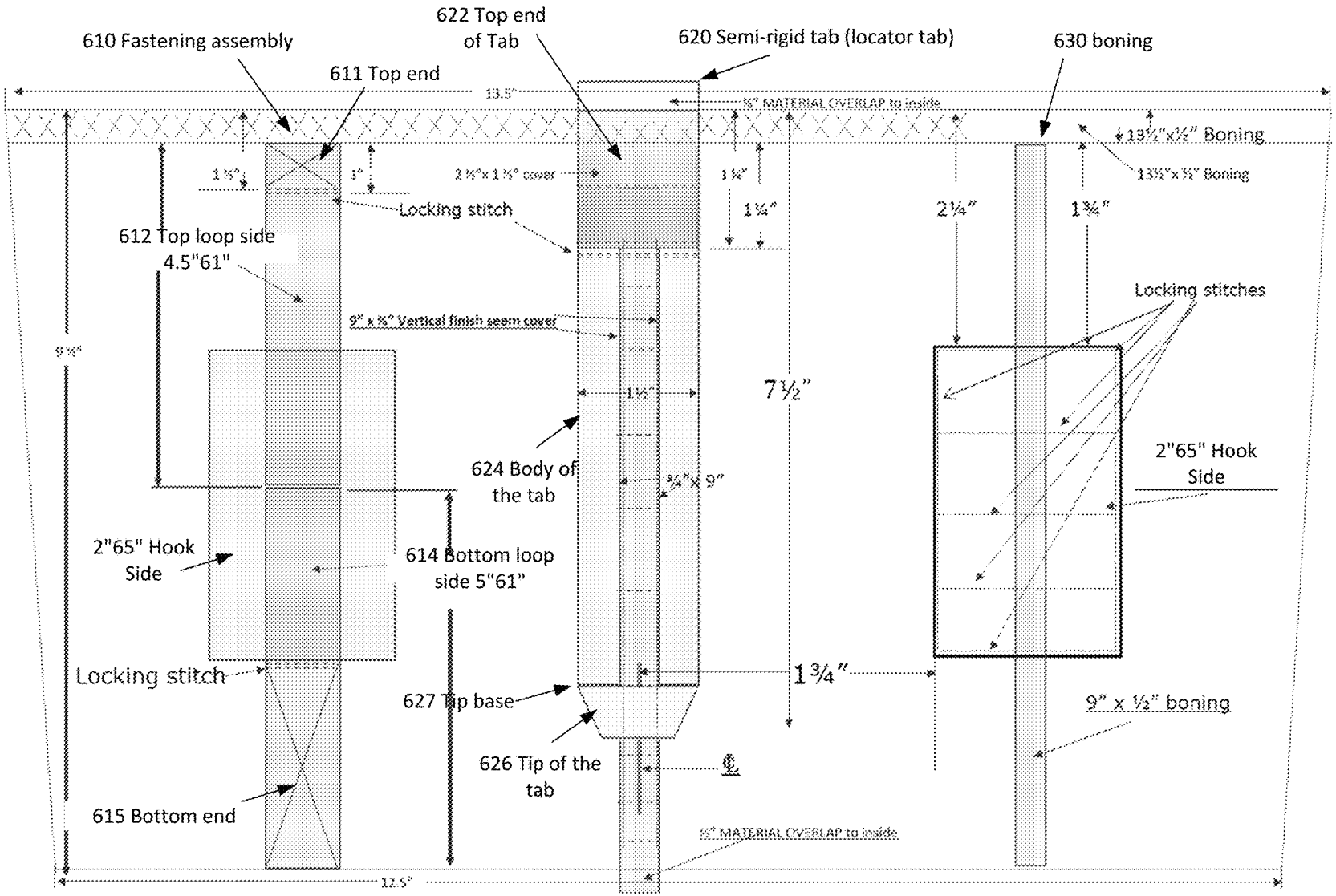
FIG. 6 illustrates an example build pattern of the weight pocket liner, in accordance with some embodiments.

FIG. 6 illustrates an example build pattern of the weight pocket liner, in accordance with some embodiments. The length, width, and thickness of the materials used in FIG. 6 are for illustrative purposes only, proper adjustments may be contemplated by a person skilled in the art according to the particular size of a target weight pocket.

As shown, the fabric forming the tubular body of the weight pocket liner is 13.5" wide (13.5 inches) at the top, 12.5" wide at the bottom, and 9.5" in height. The top opening of the weight pocket liner has a 13.5"×0.5" boning (13.5 inches in length and 0.5 inches in height). The top of the fabric is 1" wider than the bottom before the fabric is sewed into a tubular shape.

On the body of the weight pocket liner, a semi-rigid tab (also called locator tab) 620 is placed in the middle. The semi-rigid tab 620 has a top end 622 fixed to the exterior of the weight pocket liner, but the tab body 624 and the tip 626 of the tab are not fixed to the exterior. The semi-rigid tab 620 may be a thin, elongated piece of material that is relatively stiff and inflexible, but not completely rigid. It is able to bend and deform slightly under pressure or force. The rigidity of the semi-rigid tab 620 keeps the tip 626 of the tab 620 in contact with the exterior of the weight pocket liner. The body of the semi-rigid tab 620 may have an arch raised in the middle so that there is a small space between the exterior of the weight pocket liner and the body of the semi-rigid tab 620. This space is left to fit the attachment points of the weight pocket when the liner is inserted.

In some embodiments, the tip 626 of the tab 620 may be a tapered shape to facilitate insertion. The tip base 627, in some embodiments, may be wider than the width of the body of the tab 620 so that the tip 626 has two edges extended from the body of the tab 620. The two extended edges may provide additional latches to stabilize the weight pocket liner when inserted in the weight pocket.

There are at least two fastening assemblies 610 on the exterior of the weight pocket liner, and positioned on both sides of the semi-rigid tab 620. In some embodiments, the fastening assemblies 610 are Velcro assemblies. Each Velcro assembly includes a hook side fixed on the exterior of the weight pocket liner, and at least one loop side to engage with the hook side.

For simplicity and clarity, FIG. 6 shows the loop side(s) of the Velcro assembly on the left of the tab 620, and the hook side of the Velcro assembly on the right of the tab 620. The hook side may be 2"×5" in size. The Velcro assembly 610 may have two loop sides: a top loop side 612 and a bottom loop side 614. The top loop side 612 may be 4.5"×1" in size, and the bottom loop side 614 may be 5"×1" in size. The top loop side may have a top-end 611 fixed to the top of the weight pocket liner, and the bottom loop side may have a bottom-end 615 fixed to the bottom of the weight pocket liner.

In some embodiments, underneath each of the semi-rigid tab 620 and the two fastening assemblies 610, boning may be used to support the structure of the liner body. For instance, a 9"×0.5" boning strip may be sewn into the exterior underneath the two fastening assemblies 610. The boning under the semi-rigid tab 620 may be a 9"×0.75" strip, with the bottom tip of the boning overlap with (e.g., then folded into) the inside of the weight pocket liner.

Inserting the Weight Pocket Liner into a Weight Pocket of a BCD

Figure 7:
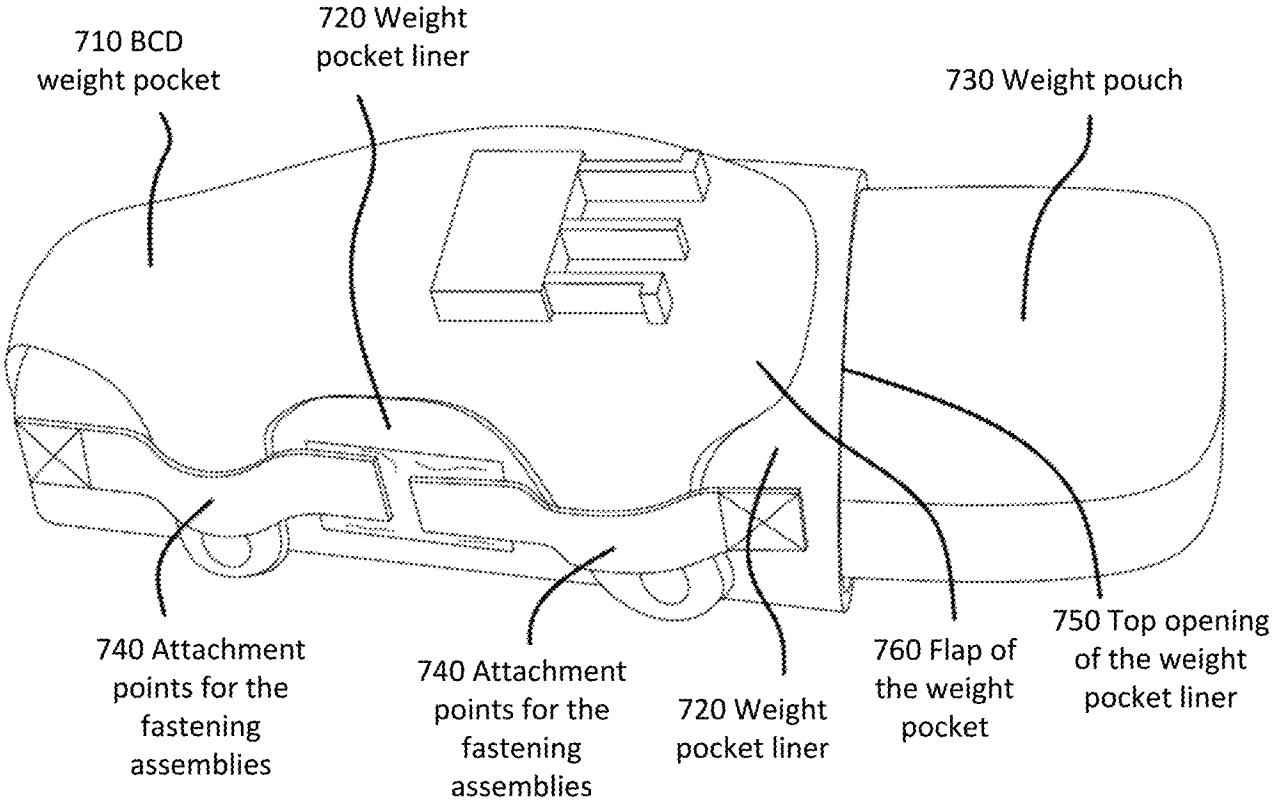
FIG. 7 illustrates a BCD weight pocket with a secured weight pocket liner, in accordance with some embodiments.

FIG. 7 illustrates a BCD weight pocket 710 with a secured weight pocket liner 720, in accordance with some embodiments. As shown, the weight pocket liner 720 is inserted in and secured to the weight pocket 710. The attachment points 740 in FIG. 7 for securing the weight pocket liner 720 are Velcro assemblies fastening to the sidebars of the weight pocket 710.

The height/length of the weight pocket liner 720 is specifically designed so that the top opening 750 of the liner is just above the flap opening 760 of the weight pocket 710. The boning of the top opening 750 keeps its open state to facilitate the insertion and removal of a weight pouch 730, which can hold a certain amount of weight (e.g., up to 12 lbs.). In addition, the waterproof fabrics on the interior of the weight pocket liner 720 effectively reduce the friction level when inserting or pulling out the weight pouch, which addresses the friction issue in the existing BCD system (e.g., without the liner 720, the friction between the canvas-type material of the weight pouch 730 and the rubber material of the weight pocket 710 is high, and will increase significantly in a wet condition).

In this disclosure, spatially relative terms such as "under," "below," "lower," "over," "upper," and the like, are used for ease of description to explain the positioning of one element relative to a second element. These terms are intended to encompass different orientations of the device in addition to different orientations than those depicted in the figures. Further, terms such as "first," "second," and the like, are also used to describe various elements, regions, sections, etc. and are also not intended to be limiting. Like terms refer to like elements throughout the description.

As used herein, the terms "having," "containing," "including," "comprising," and the like are open-ended terms that indicate the presence of stated elements or features, but do not preclude additional elements or features. The articles "a," "an" and "the" are intended to include the plural as well as the singular, unless the context clearly indicates otherwise.

Although this invention has been disclosed in the context of certain implementations and examples, it will be understood by those skilled in the art that the present invention extends beyond the specifically disclosed implementations to other alternative implementations and/or uses of the invention and obvious modifications and equivalents thereof. Thus, it is intended that the scope of the present invention herein disclosed should not be limited by the particular disclosed implementations described above.

Furthermore, the skilled artisan will recognize the interchangeability of various features from different implementations. In addition to the variations described herein, other known equivalents for each feature can be mixed and matched by one of ordinary skill in this art to construct analogous systems and techniques in accordance with principles of the present invention.

It is to be understood that not necessarily all objects or advantages may be achieved in accordance with any particular implementation of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

What is claimed is:

1. A weight pocket liner, comprising:

a tubular body made from waterproof fabrics, wherein the tubular body comprises an exterior, a top opening, and a bottom opening;

a semi-rigid tab attached to the exterior of the tubular body; and a pair of fastening assemblies attached to the exterior of the tubular body;

wherein:

the top opening comprises boning that supports the top opening in an open state;

the semi-rigid tab comprises a top end and a bottom end, wherein:

the top end is fixed to the exterior and is close to the top opening of the tubular body, the bottom end is in contact with the exterior as a result of a rigidity of the semi-rigid tab, and the bottom end is lifted away from the exterior by flexing when a lifting force is applied and automatically closes back in contact with the exterior when the lifting force disappears;

the pair of fastening assemblies are positioned on opposite sides of the semi-rigid tab;

the semi-rigid tab and the pair of fastening assemblies are parallel to each other and extended between the top opening and the bottom opening of the tubular body; and the weight pocket liner is for a buoyancy control device (BCD) to facilitate insertion and removal of weights.

2. The weight pocket liner of claim 1, wherein the bottom end of the semi-rigid tab comprises a rounded or tapered tip to facilitate insertion.

3. The weight pocket liner of claim 2, wherein at least the rounded or tapered tip of the semi-rigid tab uses a color that is different from a color of the exterior of the tubular body.

4. The weight pocket liner of claim 1, wherein the semi-rigid tab comprises an arched middle section between the top end and the bottom end, and the arched middle section is raised away from the exterior of the tubular body.

5. The weight pocket liner of claim 1, wherein the bottom end of the semi-rigid tab comprises a tip with a base side connecting to a body of the semi-rigid tab, wherein the base side of the tip is wider than a width of the body of the semi-rigid tab so that the base side of the tip comprises two edges extending from the body of the semi-rigid tab.

6. The weight pocket liner of claim 1, wherein the pair of fastening assemblies comprises a first fastening assembly positioned to a left side of the semi-rigid tab and a second fastening assembly positioned to a right side of the semi-rigid tab.

7. The weight pocket liner of claim 6, wherein each of the first fastening assembly and the second fastening assembly comprises:

a hook side fixed onto the exterior of the tubular body; and a first loop side with an upper end fixed onto the exterior of the tubular body at a first position close to the top opening.

8. The weight pocket liner of claim 7, wherein each of the first fastening assembly and the second fastening assembly further comprises:

a second loop side with a bottom end fixed onto the exterior of the tubular body at a second position close to the bottom opening.

9. The weight pocket liner of claim 7, wherein the hook side is wider than the first loop side.

10. The weight pocket liner of claim 7, wherein a first position at which the first loop side is fixed on the exterior is higher than a top of the hook side such that there is a gap between the first position and the top of the hook side.

11. The weight pocket liner of claim 1, further comprising:

a pair of boning supports on opposite sides of the tubular body, wherein each of the pair of boning supports extends from the top opening to the bottom opening, and are respectively underneath the pair of fastening assemblies.

12. The weight pocket liner of claim 1, wherein the waterproof fabrics comprise Polyester canvas with Polyvinyl Chloride (PVC) Backing.

13. The weight pocket liner of claim 1, wherein the waterproof fabrics are at least 0.55 mm in thickness and comprises a 600×600 denier.

14. The weight pocket liner of claim 1, wherein the semi-rigid tab comprises boning material providing the rigidity that is stronger than a rigidity of the boning supporting the top opening of the tubular body.

15. The weight pocket liner of claim 1, wherein the top end of the semi-rigid tab is aligned with the top opening of the tubular body.

16. The weight pocket liner of claim 1, wherein the top end of the semi-rigid tab is at least a one inch by one inch in size and sewed into the tubular body.

17. The weight pocket liner of claim 1, wherein the top opening of the tubular body has a circumference between 12 inches and 14 inches.

18. The weight pocket liner of claim 1, wherein the tubular body of the weight pocket liner has a height between 8 inches and 10 inches.

19. The weight pocket liner of claim 1, wherein the boning supporting the top opening has a thickness of a half inch.

20. The weight pocket liner of claim 1, wherein the top end is fixed to the exterior by one of the following ways: sewing in, a fastening assembly, button, zipper, or Staple gun.

* * * * *